US008843040B2

(12) United States Patent
Hasegawa et al.

(10) Patent No.: US 8,843,040 B2
(45) Date of Patent: Sep. 23, 2014

(54) COMPRESSED-AIR SHEET SEPARATION MECHANISM AND IMAGE FORMING APPARATUS INCLUDING SAME

(75) Inventors: Kenichi Hasegawa, Kanagawa (JP); Takeshi Yamamoto, Kanagawa (JP); Takashi Seto, Kanagawa (JP); Fumihiro Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 663 days.

(21) Appl. No.: 13/067,380

(22) Filed: May 27, 2011

(65) Prior Publication Data

US 2011/0305491 A1 Dec. 15, 2011

(30) Foreign Application Priority Data

Jun. 10, 2010 (JP) ..... 2010-132825

(51) Int. Cl.

| | |
|---|---|
| ***G03G 15/20*** | (2006.01) |
| ***G03G 15/00*** | (2006.01) |
| ***B65H 29/54*** | (2006.01) |

(52) U.S. Cl.

CPC ..... *B65H 29/54* (2013.01); *B65H 2406/122* (2013.01); *B65H 2801/06* (2013.01); *G03G 2215/004* (2013.01); *B65H 2515/212* (2013.01); *G03G 15/6511* (2013.01); *B65H 2406/42* (2013.01)

USPC ..... 399/323

(58) Field of Classification Search

USPC ..... 399/323

See application file for complete search history.

(56) References Cited

U.S. PATENT DOCUMENTS

| | | | |
|---|---|---|---|
| 4,168,830 | A | 9/1979 | Hori et al. |
| 6,131,009 | A | 10/2000 | Hasegawa |
| 6,496,666 | B2 | 12/2002 | Hayashi et al. |
| 6,591,081 | B2 | 7/2003 | Hasegawa |
| 7,070,182 | B2 | 7/2006 | Hasegawa |
| 7,515,850 | B2 | 4/2009 | Hasegawa |
| 7,551,882 | B2 | 6/2009 | Seto et al. |
| 7,630,652 | B2 | 12/2009 | Hasegawa |
| 7,711,300 | B2 | 5/2010 | Nakafuji et al. |
| 7,831,185 | B2 | 11/2010 | Masubuchi et al. |
| 7,925,177 | B2 | 4/2011 | Ishii et al. |
| 2002/0009306 | A1 | 1/2002 | Hayashi et al. |

(Continued)

FOREIGN PATENT DOCUMENTS

| | | |
|---|---|---|
| JP | 44-16787 | 7/1969 |
| JP | 51-133030 | 11/1976 |

(Continued)

OTHER PUBLICATIONS

Abstract of JP 2003-302859 published Oct. 24, 2003.

(Continued)

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

A sheet separation mechanism including a compressed air generator, a first nozzle to eject compressed air onto a leading edge of a sheet, a control valve provided between the compressed air generator and the first nozzle to control a flow of the compressed air, and a second nozzle provided between the control valve and the first nozzle. The control valve controls the compressed air to be simultaneously ejected from both the first nozzle and the second nozzle.

5 Claims, 4 Drawing Sheets

(56) References Cited

U.S. PATENT DOCUMENTS

| | | | | |
|---|---|---|---|---|
| 2002/0044805 | A1 | 4/2002 | Hasegawa | |
| 2004/0178573 | A1 | 9/2004 | Hasegawa | |
| 2006/0029411 | A1 | 2/2006 | Ishii et al. | |
| 2006/0257183 | A1 | 11/2006 | Ehara et al. | |
| 2007/0008395 | A1 | 1/2007 | Masubuchi et al. | |
| 2007/0014600 | A1 | 1/2007 | Ishii et al. | |
| 2007/0077104 | A1 | 4/2007 | Hasegawa | |
| 2007/0147912 | A1* | 6/2007 | Fujii | 399/323 |
| 2008/0008505 | A1 | 1/2008 | Seto et al. | |
| 2008/0069610 | A1 | 3/2008 | Nakafuji et al. | |
| 2008/0310862 | A1 | 12/2008 | Hasegawa | |
| 2009/0297199 | A1 | 12/2009 | Yamashina et al. | |
| 2010/0014903 | A1 | 1/2010 | Seto et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0232844 | A1 | 9/2010 | Saito et al. | |
| 2010/0239292 | A1 | 9/2010 | Fujita et al. | |
| 2010/0290822 | A1 | 11/2010 | Hasegawa et al. | |
| 2011/0026987 | A1 | 2/2011 | Hasegawa | |
| 2011/0026988 | A1 | 2/2011 | Yoshikawa et al. | |
| 2011/0044734 | A1 | 2/2011 | Shimokawa et al. | |
| 2011/0051201 | A1 | 3/2011 | Hashimoto et al. | |
| 2011/0052237 | A1 | 3/2011 | Yoshikawa et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0164904 | A1 | 7/2011 | Hirose et al. | |
| 2011/0176822 | A1 | 7/2011 | Ishii et al. | |
| 2011/0182609 | A1 | 7/2011 | Hasegawa et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0200370 | A1 | 8/2011 | Ikebuchi et al. | |
| 2011/0206425 | A1 | 8/2011 | Seto et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217091 | A1 | 9/2011 | Hirose et al. | |
| 2011/0217094 | A1 | 9/2011 | Hasegawa | |
| 2011/0217095 | A1 | 9/2011 | Ishii et al. | |
| 2011/0222875 | A1 | 9/2011 | Imada et al. | |
| 2011/0222929 | A1 | 9/2011 | Fujimoto et al. | |
| 2011/0222931 | A1 | 9/2011 | Shinshi et al. | |
| 2011/0222934 | A1 | 9/2011 | Hasegawa | |
| 2011/0229200 | A1 | 9/2011 | Yamaguchi et al. | |

FOREIGN PATENT DOCUMENTS

| | | | |
|---|---|---|---|
| JP | 4035705 | A | 10/2003 |
| JP | 2006-113615 | | 4/2006 |
| JP | 2008102408 | A | 5/2008 |

OTHER PUBLICATIONS

Abstract of JP 2008-102408 published May 1, 2008.

Japanese Office Action dated Dec. 24, 2013 issued in corresponding Japanese Appln. No. 2010-132825.

* cited by examiner

COMPRESSED-AIR SHEET SEPARATION MECHANISM AND IMAGE FORMING APPARATUS INCLUDING SAME

PRIORITY STATEMENT

The present patent application claims priority from Japanese Patent Application No. 2010-132825, filed on Jun. 10, 2010, in the Japan Patent Office, which is hereby incorporated herein by reference in its entirety.

BACKGROUND

1. Technical Field

Illustrative embodiments described in this patent specification generally relate to an image forming apparatus in which compressed air is used to separate a recording medium from a component therein, and more particularly to an image forming apparatus employing an electrophotographic method in which heat is used to fix an image onto a recording medium.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

An example of a widely-used system employed in the fixing device includes a heat roller fixing system, in which a fixing roller having a halogen heater or the like therein and a pressing roller pressed against the fixing roller to form a nip between the fixing roller and the pressing roller are provided so as to fix the toner image onto the sheet at the nip using heat and pressure while the sheet is sandwiched and conveyed by the rollers.

There is also known a belt fixing system, in which a seamless fixing belt is wound around a fixing roller and a heat roller having a halogen heater or the like therein. A pressing roller is pressed against the fixing roller with the fixing belt therebetween to form a nip between the pressing roller and the fixing belt. The toner image is fixed onto the sheet at the nip using heat and pressure while the sheet is sandwiched and conveyed by the fixing belt and the pressing roller.

In the above-described fixing systems using heat, melted toner of the heated toner image so as to be fixed onto the sheet can inadvertently contact the fixing roller or the fixing belt. In order to prevent adhesion of the toner and the sheet to the fixing roller or the fixing belt, a surface of the fixing roller or the fixing belt is often coated with a fluorinated resin having good releasability, and a separation pick is used to separate the sheet from the fixing roller or the fixing belt. However, because the separation pick contacts the fixing roller or the fixing belt, use of the separation pick tends to damage the surface of the fixing roller or the fixing belt, thereby causing undesired lines in a resultant image.

In general, a fixing roller employed in a monochrome image forming apparatus includes a metal roller with a surface coated with Teflon®. Accordingly, the surface of the fixing roller is not usually damaged by the separation pick, thereby extending the product life of the fixing roller. By contrast, in order to enhance coloring of full-color images, a surface layer of a fixing roller employed in a full-color image forming apparatus is formed of fluorine-coated silicone rubber such as a PFA tube having a thickness of several dozen microns or silicone rubber, with oil applied to the surface. However, the surface layer of such a fixing roller is easily damaged due to its softness, and therefore means such as the separation pick that contacts the fixing roller to separate the sheet from the fixing roller is not usually used for full-color image forming apparatuses in recent years. Instead, contactless means that separates the sheet from the fixing roller without contacting the fixing roller are often used.

However, use of the contactless means tends to cause sheet jam due to a sheet inadvertently getting wound around the fixing roller after the toner image is fixed to the sheet due to increased adhesion between the toner and the fixing roller. In particular, multiple toner layers of different colors are superimposed one atop the other in full-color image formation, thereby more often causing sheet jam due to increased adhesion between the toner and the fixing roller.

Examples of well-known means for sheet separation employed in full-color image forming apparatuses in recent years are as follows: (i) a contactless separation plate extending parallel to a longitudinal direction of a fixing roller (or a width direction of a fixing belt), with a small gap of about from 0.2 mm to 1 mm between the separation plate and the fixing roller (or the fixing belt); (ii) contactless separation picks provided at predetermined intervals, with a small gap of about from 0.2 mm to 1 mm between each of the separation picks and a fixing roller (or a fixing belt); and (iii) a self-stripping system that causes the sheet to separate from the fixing roller (or the fixing belt) by itself by taking advantage of the stiffness of the sheet and the elasticity afforded by the curve of the fixing roller (or the fixing belt).

In addition, a guide plate is provided that guides the sheet to an exit of the fixing device. The guide plate is disposed across a slight gap from the fixing roller (or the fixing belt). Consequently, a thin sheet, a sheet having a small margin at a leading edge thereof, or a sheet bearing a solid image such as a photograph thereon is not separated from the fixing roller (or the fixing belt) while being conveyed through the gap, thereby causing sheet jam. Alternatively, the sheet may contact the separation plate or the separation pick, thereby causing sheet jam.

In order to solve the above-described problems, use of compressed air ejected from a nozzle as an auxiliary for the contactless separation means has been proposed. Specifically, compressed air is ejected from the nozzle toward a sheet separation position so that the sheet is separated from the fixing roller or the fixing belt. Examples of proposed configurations using the nozzle include, but are not limited to, a configuration in which an exhaust duct having an exhaust valve is connected near an ejection opening of a duct connected to an ejection nozzle to prevent unnecessary ejection of compressed air from the nozzle to the fixing roller, and a configuration in which a channel through which compressed air flows is provided where a main body of the image forming apparatus engages a positioning pin for the fixing device.

Thus, a compressed air generator (hereinafter referred to as a compressor) and a pneumatic duct system, starting from the compressor and ending at the nozzle, that controls the compressed air generated by the compressor are provided to the image forming apparatus employing the sheet separation system, in which the compressed air is ejected from the nozzle to the sheet separation position so as to separate the sheet from a fixing member such as the fixing roller or the fixing belt without contacting and damaging the fixing member. In the pneumatic duct system, an air filter that removes water droplets and foreign substances from the compressed air, an air tank that suppresses a pressure change in the compressed air, a pressure control valve serving as a mechanical control valve that controls the compressed air in the air tank to have a predetermined pressure, an electromagnetic valve serving as an electronic control valve that controls ejection and non-ejection of the compressed air, and a pneumatic member such as the nozzle are generally provided downstream from the compressor in a direction of flow of the compressed air. The above-described components are connected with tubes to achieve the pneumatic duct system.

Moist air compressed by the compressor has a higher temperature than dry air. Therefore, when the compressed air is cooled while passing thought the pneumatic duct system, supersaturated moisture turns into water droplets. Further, in the above-described sheet separation systems, the compressed air is ejected from the nozzle into the atmosphere. As a result, the pressure of the compressed air in the pneumatic duct system is decreased, adiabatic expansions occurs, and the temperature of the compressed air is decreased. The temperature decrease also produces water droplets within the pneumatic duct system.

Because the water droplets thus generated adversely affect the components of the pneumatic duct system, means for removing the water droplets is often provided in the pneumatic duct system including the compressor. For example, the water droplets generated upstream from the air filter in the direction of flow of the compressed air accumulate in the air filter. Therefore, the accumulated water droplets are discharged from the pneumatic duct system by a removal mechanism. In addition, because the air tank is formed of metal and has a larger contact surface area with the compressed air, the compressed air tends to be cooled, thereby easily generating water droplets. The water droplets thus generated adhere to inner wall surfaces of the air tank and tubes provided downstream from the air tank in the direction of flow of the compressed air, accumulate on the bottom of the air tank, and are discharged from the pneumatic duct system by the removal mechanism. The removal mechanism is provided to the bottom of the air filter and the air tank where the water droplets accumulate, and discharges the water droplets from the pneumatic duct system by opening valves, which are main components of the removal mechanism. The valves are opened either manually, automatically using a pressure difference, or electrically using electromagnetic valves.

The larger the pressure and flow of the compressed air generated by the compressor, the more water droplets generated. When using a larger-size compressor that outputs 1 kW or more, a dehumidification device called an air dryer is provided immediately downstream from the compressor in the direction of flow of the compressed air. The air dryer forcibly cools water vapor included in hotter compressed air generated by the compressor so that the water vapor turns into water droplets. The water droplets are then captured by a water separator to be discharged from the pneumatic duct system, absorbed by an absorption agent, or separated from the compressed air using a hollow-fiber filter to be discharged from the pneumatic duct system so as to dehumidify the pneumatic duct system.

However, high-performance air dryers are costly, and larger electric energy consumption is required for cooling the water vapor. In addition, use of the hollow-fiber filter requires a higher pressure, equal to or greater than 0.2 Mpa. In general, an amount of pressure required for sheet separation in the image forming apparatus is as small as from 0.05 MPa to 0.2 MPa, and a required amount of flow of the compressed air is small. Therefore, a compact compressor that outputs 200 W or less is generally employed in the image forming apparatus. Because the amounts of pressure and flow of the compressed air generated by the compact compressor are smaller compared to the previously-described larger-size compressor, fewer water droplets are generated in the compressed air. Thus, it is not practical to employ a high-performance air dryer in the image forming apparatus.

In order to efficiently eject the compressed air from the nozzle, it is preferable that the pneumatic duct system that connects the air tank, the electromagnetic valve, and the nozzle have low resistance and volume. Therefore, in an image forming apparatus including a low-output compressor, a water droplet collector such as an air filter having larger resistance and volume is not often provided in the pneumatic duct system.

In the image forming apparatus in which sheet separation is performed by ejecting the compressed air, the compressed air is ejected each time the sheet passes. Therefore, the water droplets adhering to the inside of the pneumatic duct system, particularly a part of the duct system provided downstream from the air tank in the direction of flow of the compressed air, are discharged from the nozzle. Fewer water droplets are ejected from the nozzle for each ejection, thereby preventing blots on the sheet.

However, more water droplets pass through the duct system during a longer operating period under higher temperature and humidity conditions in which the air has a moisture content. Consequently, the water droplets often accumulate on parts of the duct system having a larger resistance, such as joints and branching portions between pneumatic devices. The water droplets thus accumulated are ejected from the nozzle in large numbers in any given ejection. Consequently, the water droplets thus ejected adhere to the fixing member or the sheet. Further, the water droplets generated within the pneumatic duct system adversely affect operation of the pneumatic devices such as the electromagnetic valve and the pressure control valve, thereby shortening the life of the pneumatic duct system.

SUMMARY

In view of the foregoing, illustrative embodiments described herein provide an improved sheet separation mechanism included in an image forming apparatus. The sheet separation mechanism includes a compressed air generator that does not contaminate a sheet and components of the image forming apparatus with water droplets during a longer operating time under higher temperature and humidity conditions.

At least one embodiment provides a sheet separation mechanism including a compressed air generator, a first nozzle to eject compressed air onto a leading edge of a sheet, a control valve provided between the compressed air generator and the first nozzle to control a flow of the compressed air, and a second nozzle provided between the control valve and the first nozzle. The control valve controls the compressed air to be simultaneously ejected from both the first nozzle and the second nozzle.

At least one embodiment provides an image forming apparatus including the sheet separation mechanism described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
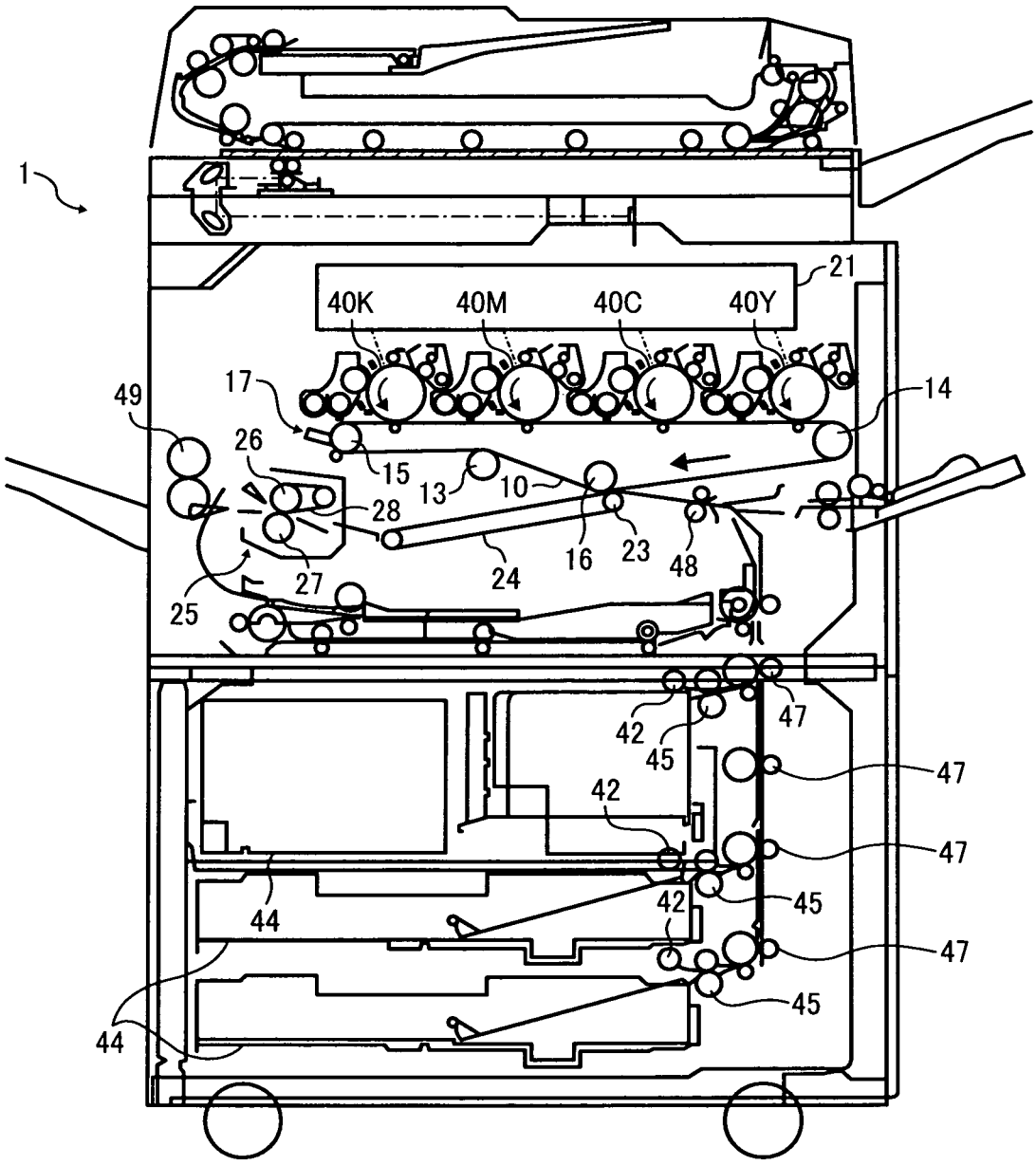
FIG. 1 is a vertical cross-sectional view illustrating an example of a configuration of an image forming apparatus according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings, wherein like reference numerals designate identical or corresponding parts throughout the several views.

A configuration and operation of a tandem type full-color copier employing an intermediate transfer system serving as an image forming apparatus 1 according to illustrative embodiments is described in detail below.

FIG. 1 is a vertical cross-sectional view illustrating an example of a configuration of the image forming apparatus 1. The image forming apparatus 1 continuously prints on 120 sheets of A4-size paper per minute or 60 sheets of A3-size paper per minute, and is designed to be used under a temperature of from 10° C. to 30° C. and a humidity of from 20% to 80%. The image forming apparatus 1 includes a seamless intermediate transfer belt 10 at the center thereof. The intermediate transfer belt 10 is wound around support rollers 13, 14, 15, and 16 to be rotatable in a clockwise direction in FIG. 1.

A belt cleaning device 17 that removes residual toner from the intermediate transfer belt 10 after transfer of toner images is provided on the left of the support roller 15. The toner removed by the belt cleaning device 17 is conveyed to a back part of the image forming apparatus 1 by a conveyance unit, not shown, and then falls downward by its own weight to be collected to a waste toner bottle, not shown. A detector that detects an amount of collected toner is provided to the waste toner bottle so that the waste toner bottle stops collecting the toner when being filled up with the toner. Accordingly, overflow of the toner from the waste toner bottle is prevented.

The image forming apparatus 1 further includes four image forming units, each forming an image of a specific color, that is, black (K), magenta (M), cyan (C), or yellow (Y), arranged side by side along a direction of rotation of the intermediate transfer belt 10. The four image forming units are provided above the intermediate transfer belt 10, and an irradiating device 21 is provided above the four image forming units.

The secondary transfer roller 23 is provided opposite the support roller 16 positioned at the lower center within a loop of the intermediate transfer belt 10. The secondary transfer roller 23 is included in a secondary transfer device, and a fixing device 25 that fixes transferred toner images to a sheet is provided downstream from the secondary transfer device in a direction of conveyance of the sheet. The fixing device 25 includes a fixing roller 26, a fixing belt 28 serving as a fixing member or a conveyance member, and a pressing roller 27 serving as a pressing member pressed against the fixing roller 26 with the fixing belt 28 interposed therebetween.

When a start button, not shown, is pressed, one of the support rollers 14, 15, and 16 is rotatively driven by a drive motor, not shown, so that the rest of the support rollers 14, 15, and 16 and the support roller 13 are rotated to rotate the intermediate transfer belt 10. At the same time, photoconductors 40K, 40M, 40C, and 40Y (hereinafter collectively referred to as photoconductors 40) provided in the four image forming units, respectively, are rotated to form toner images of the specified color, that is, black (K), magenta (M), cyan (C), or yellow (Y), on the photoconductors 40. The toner images thus formed are sequentially transferred from the photoconductors 40 onto the intermediate transfer belt 10 as the intermediate transfer belt 10 is rotated so that the toner images are superimposed one atop the other to form a full-color toner image on the intermediate transfer belt 10.

Meanwhile, one of sheet feed rollers 42 provided to a sheet feeder is selectively rotated by pressing the start button so as to feed a sheet from one of multiple sheet feed cassettes 44 provided one above the other in a paper bank. Specifically, sheets stored in the sheet feed cassette 44 are separated one by one by a separation roller 45 to be conveyed through a sheet feed path by conveyance rollers 47. Conveyance of the sheet is temporarily stopped when the sheet contacts a pair of registration rollers 48. The pair of registration rollers 48 is rotated in synchronization with the full-color toner image formed on the intermediate transfer belt 10 to convey the sheet between the intermediate transfer belt 10 and the secondary transfer roller 23. Accordingly, the full-color toner image is transferred onto the sheet from the intermediate transfer belt 10 by the secondary transfer roller 23.

The sheet having the full-color toner image thereon is then conveyed to the fixing device 25 by a conveyance belt 24 included in the secondary transfer device. In the fixing device 25, heat and pressure are applied to the sheet to fix the full-color toner image onto the sheet. The sheet having the fixed full-color image thereon is then discharged by a discharge roller 49 to be stacked on a discharge tray. Meanwhile, the belt cleaning device 17 removes residual toner from the intermediate transfer belt 10 after the full-color toner image is transferred onto the sheet to be ready for the next sequence of image formation.

Figure 2:
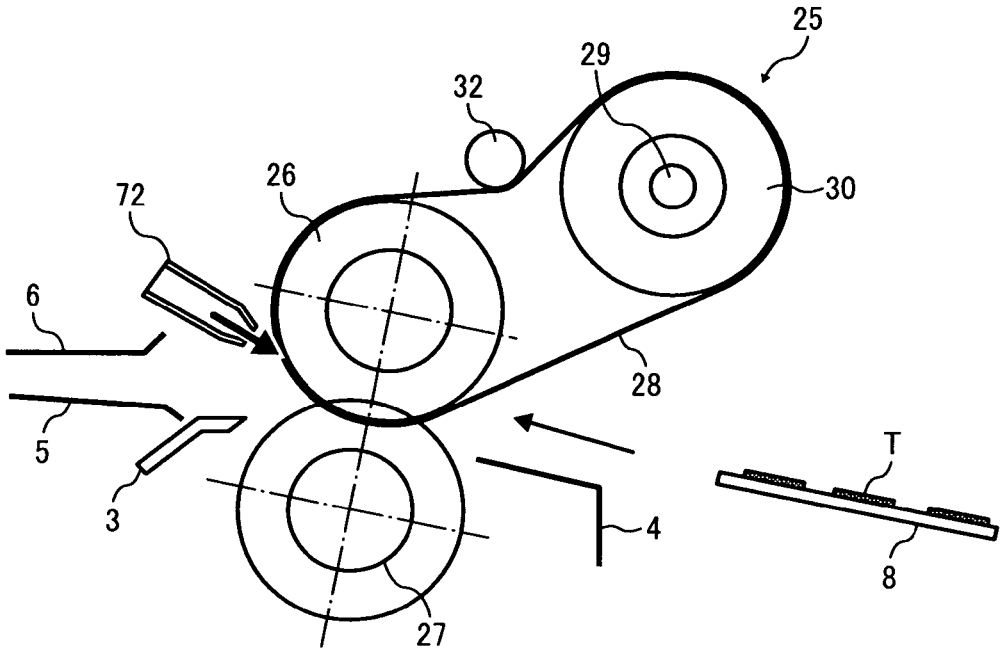
FIG. 2 is a schematic view illustrating a configuration of a fixing device employing a separation mechanism according to illustrative embodiments.

A description is now given of a configuration and operation of the fixing device 25 with reference to FIG. 2. FIG. 2 is a vertical cross-sectional view illustrating an example of a configuration of the fixing device 25 employing a separation mechanism using air. Although the fixing device 25 according to illustrative embodiments employs a belt fixing system, the configuration of the fixing device 25 is not limited thereto. Alternatively, for example, the fixing device 25 may employ a roller fixing system in which a fixing member having a heat source and a pair of rollers each serving as a pressing member pressed by the fixing member are provided. In the fixing device 25, the fixing belt 28 is rotatably wound around the fixing roller 26 serving as a drive roller and a heat roller 30 serving as a driven roller. A heater 29 is provided within the heat roller 30 and heats the heat roller 30 so as to heat the fixing belt 28. The pressing roller 27 is provided opposite the fixing roller 26 with the fixing belt 28 interposed therebetween, and is pressed against the fixing roller 26 by a pressing mechanism, not shown. The fixing device 25 further includes a tension roller 32 that enables a contact surface area of the fixing belt 28 with the heat roller 30 to increase so that a lager amount of heat is transmitted from the heat roller 30 to the fixing belt 28. The fixing belt 28 is rotated as the fixing roller 26 is rotatively driven by a drive mechanism, not shown, and the pressing roller 27 is rotated as the fixing belt 28 rotates. It is to be noted that the pressing roller 27 may also be rotatively driven by the drive mechanism. A temperature on a surface of the fixing belt 28 is detected by a detector, not shown, and a temperature controller, not shown, controls the heater 29 based on a value output from the detector such that the surface of the fixing belt 28 has a predetermined temperature. A sheet 8 bearing an unfixed full-color toner image thereon conveyed to the fixing device 25 passes through a nip formed between the pressing roller 27 and the fixing belt 28 having the predetermined temperature. At this time, toner T of the full-color toner image is melted and fixed onto the sheet 8. Thereafter, the sheet 8 having the fixed full-color image thereon is discharged from the image forming apparatus 1.

The fixing device 25 further includes first nozzles 72 that eject compressed air to the nip, a cleaning web, not shown, and an oil applicator, not shown. Further, an entrance guide 4 is provided at the entrance of the fixing device 25, and exit guides 5 and 6 arranged one above the other are provided at the exit of the fixing device 25. The pressing roller 27 is provided with a separation plate 3.

Although not shown in FIG. 2, six first nozzles 72 are arranged side by side in the fixing device 25, and a diameter of each of the first nozzles 72 is ϕ1 mm. It is to be noted that, only a leading edge of one of the six first nozzles 72 is shown in FIG. 2, and the first nozzles 72 may alternatively be provided parallel to the separation plate 3. Compressed air controlled by a compressed air supplier and an electromagnetic valve, both not shown in FIG. 2, flows through ducts within the first nozzles 72 to be ejected once to the nip when a leading edge of the sheet 8 passes through the nip. As a result, the leading edge of the sheet 8 is compulsorily separated from the fixing belt 28 by a flow of the compressed air. The above-described ejection of the compressed air is performed each time the sheet 8 is conveyed through the nip during continuous printing operation.

Figure 3:
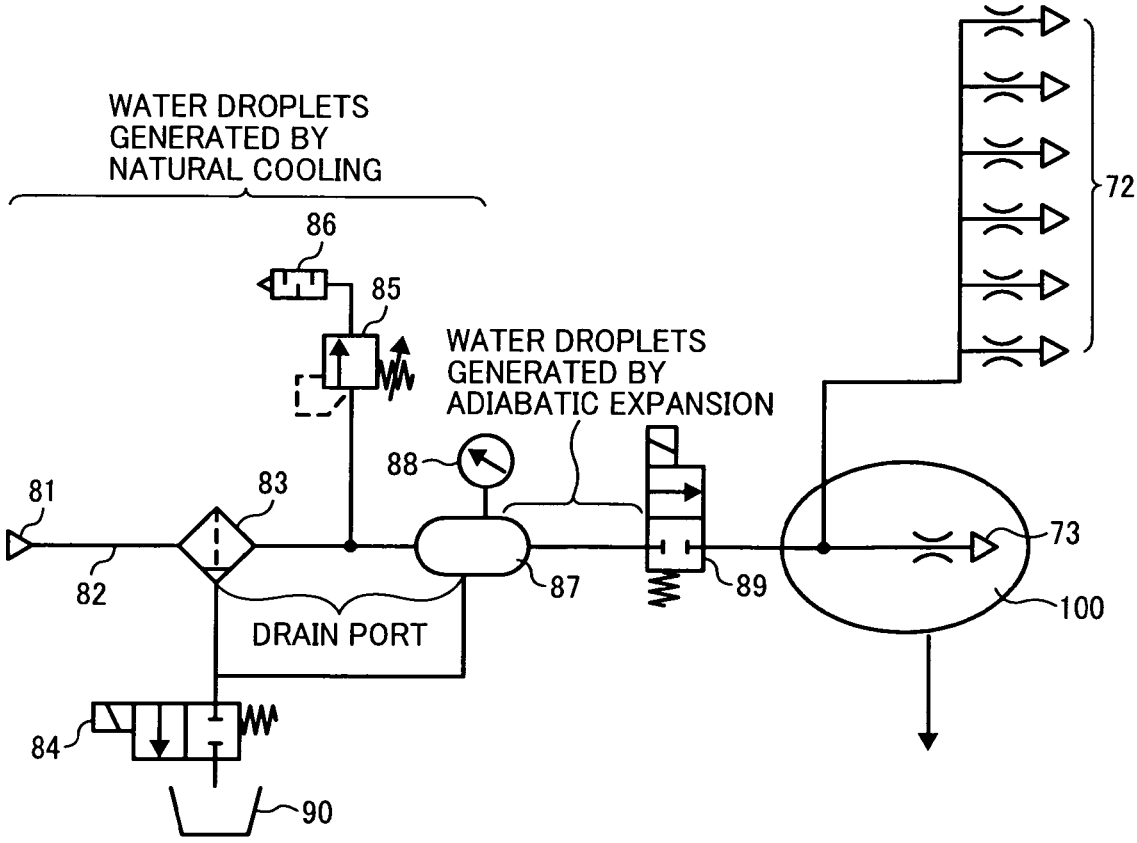
FIG. 3 is a schematic view illustrating a pneumatic duct system from a compressed air generator to nozzles according to illustrative embodiments.

FIG. 3 is a schematic view illustrating an example of a configuration of a pneumatic duct system starting from a compressed air generator (hereinafter referred to as a compressor 81). The pneumatic duct system controls compressed air generated by the compressor 81. The compressor 81 is a compact reciprocating compressor that outputs 100 W, and can compress air to 0.4 MPa. The compressor 81 has no pressure adjustment mechanism, and therefore, the pressure in the compressor 81 is controlled by a part of the pneumatic duct system provided downstream from the compressor 81 in a direction of flow of the compressed air (hereinafter referred to as the downstream part of the pneumatic duct system). The higher the pressure in the downstream part of the pneumatic duct system, the smaller the flow of compressed air (L/min) in the compressor 81. Therefore, the compressor 81 can be activated only when the pneumatic duct system is at atmospheric pressure, that is, 0 MPa.

A filter is provided to a suction opening, not shown, of the compressor 81 in order to prevent mixing of foreign substances into the compressed air. Hot compressed air from the compressor 81 is conveyed to an air filter 83 via a tube 82. The compressed air is naturally cooled when passing through the tube 82, resulting in generation of water droplets.

In general, flexible hollow tubes formed of polyurethane, nylon, or a fluorinated resin or metal pipes are used for the pneumatic duct system. It is desirable that the compressed air having a higher temperature be cooled to room temperature while passing through the tube 82. Therefore, it is preferable that the tube 82 be a long metal pipe having higher thermal conductivity. In addition, the long metal pipe may be provided with a radiator fin.

In order to prevent the water droplets generated within the tube 82 from flowing back into the compressor 81 at shutdown, it is preferable that either the tube 82 be provided below the compressor 81 or that a check valve be provided.

The air filter 83 removes foreign substances such as dust from the compressed air and collects the water droplets generated within the pneumatic duct system to discharge the water droplets from the system. A water separator has been known as a device that collects water droplets. Although the water separator does not have a function of removing foreign substances, it has higher water removal performance of a water removal rate of 99%.

A first electromagnetic valve 84 is provided to a drain port of the air filter 83 to discharge pressure and water droplets from the duct system. Specifically, the first electromagnetic valve 84 is controlled to be opened upon shutdown of the image forming apparatus 1 to discharge pressure in the duct system and the water droplets accumulated in the air filter 83. The water droplets thus discharged fall into an evaporating dish 90 to be naturally evaporated.

An air tank 87 is provided downstream from the air filter 83 in the direction of flow of the compressed air to serve as a buffer for ejection of the compressed air, thereby achieving stable ejection of the compressed air. In illustrative embodiments, the air tank 87 is produced by welding together steel plates having a thickness of 5 mm, and has a volume of 1 L. Because higher pressure is applied to the air tank 87, the air tank 87 is formed of metal having higher rigidity. Taking occurrence of unexpected situations into consideration, the air tank 87 is designed to tolerate a pressure greater than the maximum possible pressure in the compressor 81. Because it takes a longer time for the air tank 87 to have a setting pressure when the volume of the air tank 87 is too large, it is preferable that the air tank 87 have a volume as small as possible to provide stable ejection pressure, that is, 1 L in illustrative embodiments. It is to be noted that no provision of the air tank 87 is needed depending on specifications of the first nozzles 72 and ejection of the compressed air. Alternatively, the air filter 83 having a larger volume may be used in place of the air tank 87.

The air tank 87 is formed of metal and has a larger contact surface area with the compressed air, thereby easily cooling the compressed air. Vapor which cannot be turned into water droplets in a part of the duct system provided upstream from the air tank 87 is turned into water droplets in the air tank 87. The water droplets thus generated adhere to inner walls of the air tank 87 and accumulate on a bottom surface of the air tank 87. The bottom surface of the air tank 87 is provided with a drain port channeled to the first electromagnetic valve 84, and pressure and the water droplets are discharged from the drain port during shutdown of the image forming apparatus 1. A manometer 88 is provided to the air tank 87 so that the pressure can be visually confirmed.

A pressure adjustment valve (or a relief valve) 85 is provided between the air filter 83 and the air tank 87, and discharges the compressed air when the pressure in the air tank 87 reaches a predetermined amount so that the air tank 87 is controlled to have a constant pressure. The pressure adjustment valve 85 is adjustable using a screw. Specifically, the screw of the pressure adjustment valve 85 is adjustably fixed such that the air tank 87 has a predetermined pressure during operation of the compressor 81. In illustrative embodiments, the screw of the pressure adjustment valve 85 is adjusted such that the air tank 87 has a pressure of 0.1 Mpa during operation of the compressor 81. In order to reduce a sound of the compressed air discharged from the pressure adjustment valve 85, a silencer 86 is provided.

A second electromagnetic valve 89 serving as a control valve is provided downstream from the air tank 87. The second electromagnetic valve 89 has two ports, and is closed when power is not distributed and is opened when power is distributed. Drive of the second electromagnetic valve 89 ejects the compressed air within the air tank 87 from the first nozzles 72 to the nip in the fixing device 25 each time the sheet 8 passes through the nip. The second electromagnetic valve 89 is driven to start ejection of the compressed air before the leading edge of the sheet 8 reaches the nip, and driving of the second electromagnetic valve 89 is stopped after separation of the sheet 8 from the fixing belt 28 to complete ejection of the compressed air. In illustrative embodiments, the compressed air is ejected from the first nozzles 72 for 100 ms for each ejection.

When the second electromagnetic valve 89 is driven, the compressed air in the air tank 87 and a tube between the air tank 87 and the second electromagnetic valve 89 is adiabatically expanded and cooled, thereby generating water droplets. The water droplets thus generated adhere to inner surfaces of the duct system and are moved to a downstream side in the direction of flow of the compressed air each time the compressed air is ejected. Consequently, the water droplets may be ejected from the first nozzles 72 together with the compressed air. Alternatively, the water droplets adhering to the inner surfaces of the duct system tend to accumulate on portions having a larger resistance such as joints and branching portions in the duct system. In illustrative embodiments, a second nozzle 73 is provided between the second electromagnetic valve 89 and the first nozzles 72. When the second electromagnetic valve 89 is driven, the compressed air is ejected also from the second nozzle 73 at the same time when the compressed air is ejected from the first nozzles 72. Accordingly, the water droplets adhering to the inner surfaces of the duct system are discharged from the second nozzle 73 together with the compressed air.

Figure 4:
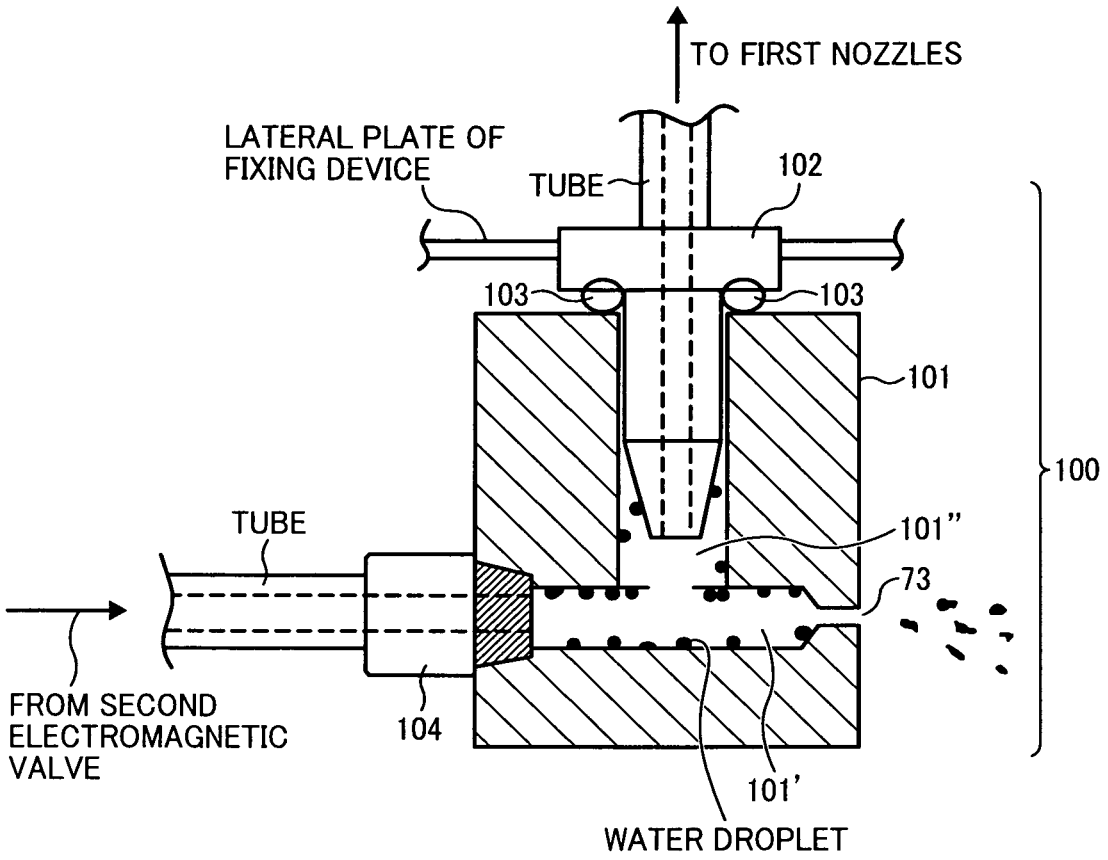
FIG. 4 is a plan view illustrating a configuration of a second nozzle according to a first illustrative embodiment.

FIG. 4 is a plan view illustrating a configuration of the second nozzle 73 according to a first illustrative embodiment. A connector unit 100 including the second nozzle 73 is provided as a part of the pneumatic duct system in the fixing device 25 detachably attachable to the image forming apparatus 1. The connector unit 100 further includes a first connector 101 provided to the image forming apparatus 1 and a second connector 102 provided to the fixing device 25. In the first connector 101, a first duct 101' and a second duct 101" provided perpendicular to the first duct 101' are formed in a metal block. A coupling 104 is provided upstream from the first duct 101' in the direction of flow of the compressed air, and is connected to the second electromagnetic valve 89 via a tube. The second nozzle 73 is provided downstream from the first duct 101' in the direction of flow of the compressed air. The number of the second nozzle 73 provided to the connector unit 100 is one, and a diameter of the second nozzle 73 is ϕ1 mm. By contrast, the number of the first nozzles 72 is six, and the diameter of each of the first nozzles 72 is ϕ1 mm as described above. Thus, a cross-sectional area of the second nozzle 73 is one-sixth of a total cross-sectional area of the first nozzles 72. The larger the diameter of the second nozzle 73, the weaker is the compressed air ejected from the first nozzles 72. Therefore, it is preferable that the cross-sectional area of the second nozzle 73 be from one-fifth to one-fiftieth of the total cross-sectional area of the first nozzles 72.

The second connector 102 is fitted into the second duct 101" provided perpendicular to the first duct 101'. The second connector 102 has a hollow shaft with a tapered leading edge and a flange. O-rings 103 are mounted on a lateral surface of the flange provided closer to the first connector 101, and the flange is fixed to a lateral plate of the fixing device 25. The O-rings 103 contact an outer surface of the first connector 101 to prevent leakage of the compressed air. The leading edge of the second connector 102 is tapered as described above so as to be easily inserted into the first connector 101 when the fixing device 25 is attached to the image forming apparatus 1. In addition, the tapered leading edge of the second connector 102 inserted into the second duct 101" in the first connector 101 does not contact an inner wall surface of the second duct 101".

As described previously, the water droplets generated in the pneumatic duct system adhere to the inner surfaces of the duct system and are moved to the downstream side in the direction of flow of the compressed air each time the compressed air is ejected. Thus, when reaching the first connector 101, the water droplets adhere to an inner wall surface of the first duct 101'. Because the second duct 101" is provided perpendicular to the first duct 101', the water droplets rarely enter in the second duct 101". Further, even if the water droplets enter in the second duct 101" and adhere to an inner wall surface of the second duct 101", such water droplets rarely enter in the second connector 102 because the tapered leading edge of the second connector 102 protruding toward the center of the second duct 101" is apart from the inner wall surface of the second duct 101". Accordingly, the water droplets tend to accumulate in the first duct 101'.

The second nozzle 73 is provided to the first duct 101' so that the water droplets accumulated in the first duct 101' are discharged from the second nozzle 73 each time the compressed air is ejected from the second nozzle 73. Although the cross-sectional area of the second nozzle 73 is smaller than the total cross-sectional area of the first nozzles 72 and an amount of the compressed air ejected from the second nozzle 73 is smaller than that ejected from the first nozzles 72, the pneumatic duct system is designed such that the water droplets tend to accumulate immediately in front of the second nozzle 73. Accordingly, the water droplets are efficiently discharged from the second nozzle 73.

It is to be noted that operation of the second nozzle 73 can be checked by a repair person. Because the first nozzles 72 are provided inside the fixing device 25, ejection of the compressed air from the first nozzles 72 cannot be visually confirmed during operation. By contrast, the second nozzle 73 is uncovered, and therefore, ejection of the water droplets or the compressed air from the second nozzle 73 can be visually confirmed. In addition, use of a commercially-produced manometer having a hollow needle serving as a detector can measure a pressure in the first duct 101' by inserting the hollow needle into the second nozzle 73. The pressure in the first duct 101' is measured to diagnose the pneumatic duct system.

Figure 5:
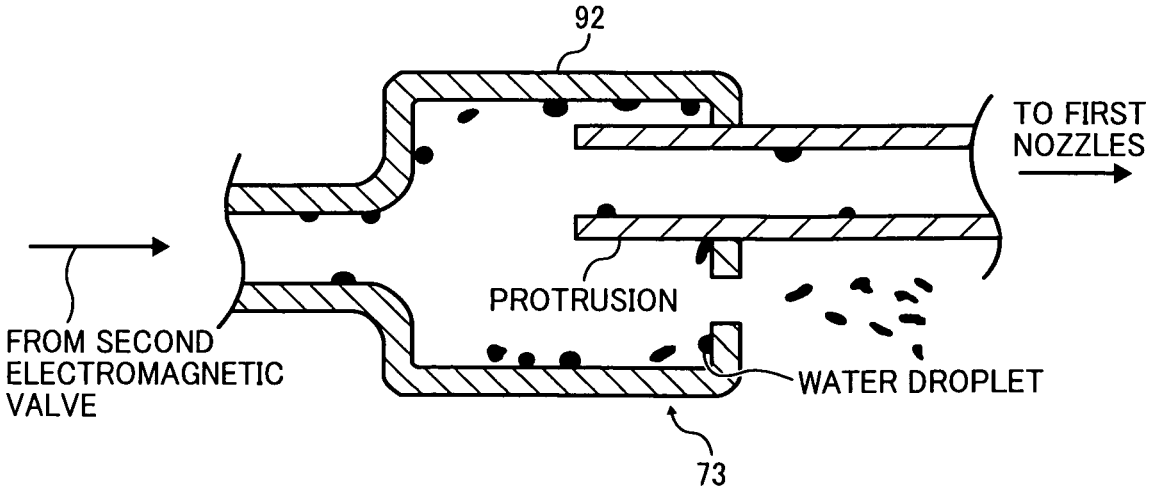
FIG. 5 is a schematic view illustrating a configuration of a second nozzle according to a second illustrative embodiment.

A description is now given of a second illustrative embodiment of the present invention. FIG. 5 is a schematic view illustrating a configuration of the second nozzle 73 according to the second illustrative embodiment. In the second illustrative embodiment, a hollow box-shaped nozzle block 92 provided with an ejection opening serves as the second nozzle 73. Similar to the first illustrative embodiment, the nozzle block 92 is connected to the second electromagnetic valve 89 and the first nozzles 72 via tubes, respectively. The tube that connects the nozzle block 92 and the first nozzles 72 protrudes inside the nozzle block 92. Accordingly, water droplets adhering to inner wall surfaces of the nozzle block 92 rarely enter in the tube. The water droplets accumulated within the nozzle block 92 are discharged from the ejection opening.

Figure 6:
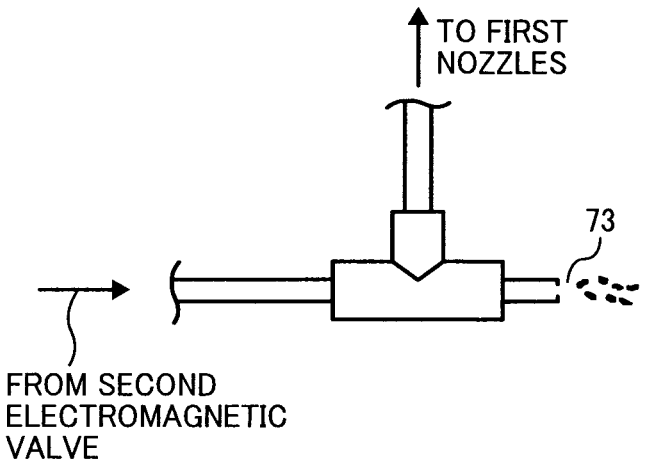
FIG. 6 is a schematic view illustrating a configuration of a second nozzle according to a third illustrative embodiment.

A description is now given of a third illustrative embodiment of the present invention. FIG. 6 is a schematic view illustrating a configuration of the second nozzle 73 according to the third illustrative embodiment. In the third illustrative embodiment, a T-shaped connector is provided to a branching portion between the first nozzles 72 and the second nozzle 73. The second electromagnetic valve 89 and the second nozzle 73 are arranged linearly, and the first nozzles 72 are provided above the second nozzle 73 perpendicular to the second electromagnetic valve 89 and the second nozzle 73. The water droplets adhering to the inside of the duct system tend to move in a straight direction, and therefore, they are moved to the second nozzle 73 to be discharged from the second nozzle 73.

Figure 7:
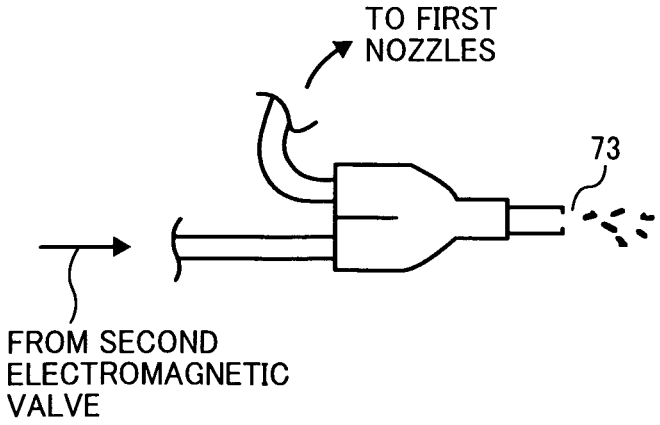
FIG. 7 is a schematic view illustrating a configuration of a second nozzle according to a fourth illustrative embodiment.

A description is now given of a fourth illustrative embodiment of the present invention. FIG. 7 is a schematic view illustrating a configuration of the second nozzle 73 according to the fourth illustrative embodiment. In the fourth illustrative embodiment, a Y-shaped connector is provided to the branching portion between the first nozzles 72 and the second nozzle 73. The second electromagnetic valve 89 and the second nozzle 73 are substantially arranged linearly, and the first nozzles 72 are provided to make a turn from the second electromagnetic valve 89. The water droplets adhering to the inside of the duct system tend to move in a straight direction, and therefore, they are moved to the second nozzle 73 to be discharged from the second nozzle 73.

In the third and fourth illustrative embodiments, it is preferable that the second nozzle 73 be provided below the first nozzles 72 as shown in FIGS. 6 and 7. As a result, in a case in which the water droplets that are not discharged from the second nozzle 73 adhere to an inner surface of the tube connected to the first nozzles 72, such water droplets are moved to the second nozzle 73 by their own weight during shutdown of the image forming apparatus 1. Therefore, the water droplets are discharged from the second nozzle 73 at the start of operation of the image forming apparatus 1. Similarly, it is preferable that the second nozzle 73 be provided below the tube connected to the second electromagnetic valve 89. Accordingly, entrance of the water droplets in the second electromagnetic valve 89 during shutdown of the image forming apparatus 1 can be prevented, thereby preventing deterioration of the second electromagnetic valve 89 caused by the water droplets.

The foregoing illustrative embodiments are applicable not only to the sheet separation mechanism for the fixing device 25 but also to a sheet separation mechanism for the other components in the image forming apparatus 1, such as the photoconductors 40 and the transfer device. In addition, the foregoing illustrative embodiments may be used for cleaning a detection surface of each of multiple contactless sensors, such as a sensor that detect a temperature of the fixing member and a sensor that detects presence of the sheet 8 in the conveyance path, provided to the image forming apparatus 1 by ejecting the compressed air without the water droplets to the detection surface.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. A sheet separation mechanism comprising:

a compressed air generator;

a first nozzle to eject compressed air onto a leading edge of a sheet;

a control valve provided between the compressed air generator and the first nozzle to control a flow of the compressed air;

a second nozzle provided between the control valve and the first nozzle, the control valve controlling the compressed air to be simultaneously ejected from both the first nozzle and the second nozzle; and a branching passageway between the control valve and the first nozzle and the second nozzle that provides the first nozzle with a duct resistance larger than an air resistance of the second nozzle.

2. The sheet separation mechanism according to claim 1, further comprising a tube connected to the first nozzle, wherein an upstream terminal of the tube protrudes into the branching passageway.

3. An image forming apparatus comprising the sheet separation mechanism according to claim 1.

4. A sheet separation mechanism comprising:

a compressed air generator;

a first nozzle to eject compressed air onto a leading edge of a sheet;

a control valve provided between the compressed air generator and the first nozzle to control a flow of the compressed air; and a second nozzle provided between the control valve and the first nozzle, the control valve controlling the compressed air to be simultaneously ejected from both the first nozzle and the second nozzle, wherein:

the first nozzle is provided to a fixing device; and the second nozzle is provided to a connector unit detachably attachable between an image forming apparatus and the fixing device.

5. A sheet separation mechanism comprising:

a compressed air generator;

a first nozzle to eject compressed air onto a leading edge of a sheet;

a control valve provided between the compressed air generator and the first nozzle to control a flow of the compressed air; and a second nozzle provided between the control valve and the first nozzle, the control valve controlling the compressed air to be simultaneously ejected from both the first nozzle and the second nozzle, wherein a cross-sectional area of the second nozzle is smaller than a total cross-sectional area of the multiple first nozzles.

* * * * *